US009988841B2

(12) United States Patent
Hall et al.

(10) Patent No.: US 9,988,841 B2
(45) Date of Patent: Jun. 5, 2018

(54) WINDOW COVERING AND SENSORS TO REDUCE CONVECTION

(71) Applicants: David R. Hall, Provo, UT (US); Austin Carlson, Provo, UT (US); Jerome Miles, Spanish Fork, UT (US); Kevin Rees, Herriman, UT (US); Emily Brimhall, Alpine, UT (US); Joe Fox, Spanish Fork, UT (US); Jedediah Knight, Provo, UT (US)

(72) Inventors: David R. Hall, Provo, UT (US); Austin Carlson, Provo, UT (US); Jerome Miles, Spanish Fork, UT (US); Kevin Rees, Herriman, UT (US); Emily Brimhall, Alpine, UT (US); Joe Fox, Spanish Fork, UT (US); Jedediah Knight, Provo, UT (US)

( * ) Notice: Subject to any disclaimer, the term of this patent is extended or adjusted under 35 U.S.C. 154(b) by 0 days. days.

(21) Appl. No.: 15/208,839

(22) Filed: Jul. 13, 2016

(65) Prior Publication Data

US 2018/0016840 A1 Jan. 18, 2018

(51) Int. Cl.

| | |
|---|---|
| ***E06B 9/68*** | (2006.01) |
| ***E06B 9/24*** | (2006.01) |
| ***E06B 9/32*** | (2006.01) |
| ***E06B 9/36*** | (2006.01) |

(52) U.S. Cl.

CPC ..... *E06B 9/68* (2013.01); *E06B 9/24* (2013.01); *E06B 9/32* (2013.01); *E06B 9/368* (2013.01); *E06B 2009/6809* (2013.01); *E06B 2009/6818* (2013.01)

(58) Field of Classification Search

CPC ..... E06B 9/68; E06B 9/32; E06B 9/24; E06B 9/368; E06B 2009/6818; E06B 2009/6809

See application file for complete search history.

(56) References Cited

U.S. PATENT DOCUMENTS

| | | | | |
|---|---|---|---|---|
| 4,950,871 | A * | 8/1990 | Pollak | F24D 9/00 126/110 AA |
| 6,369,935 | B1 * | 4/2002 | Cardinal | E06B 9/24 359/241 |
| 9,569,955 | B2 * | 2/2017 | Hall | H02P 29/027 |
| 9,834,983 | B1 * | 12/2017 | Hall | E06B 9/307 |
| 2003/0146289 | A1 * | 8/2003 | Sekhar | F24F 3/0442 236/49.3 |

(Continued)

FOREIGN PATENT DOCUMENTS

WO WO 2016011040 * 1/2016

*Primary Examiner* — Blair M Johnson

(57) ABSTRACT

A system to reduce drafts in front of a window is described. The system includes a window covering and a motor and gearbox that adjust the window covering. The system also includes a first temperature sensor, a second temperature sensor, and a microcontroller networked to the motor and temperature sensors. The first temperature sensor is positioned above the window covering within a thermal convection zone of a window associated with the window covering, and the second temperature sensor is positioned below the window covering within the thermal convection zone. The microcontroller instructs the motor to adjust the window covering based on a temperature gradient from the first temperature sensor to the second temperature sensor.

12 Claims, 16 Drawing Sheets

(56) References Cited

U.S. PATENT DOCUMENTS

| | | | | |
|---|---|---|---|---|
| 2011/0270446 | A1* | 11/2011 | Scharf | F24F 11/0001 700/282 |
| 2012/0107085 | A1* | 5/2012 | McCowan | F03D 3/0409 415/1 |
| 2013/0233496 | A1* | 9/2013 | Ogden, Jr. | E06B 9/322 160/84.02 |
| 2015/0086383 | A1* | 3/2015 | Toy | F04D 25/088 417/32 |
| 2015/0160626 | A1* | 6/2015 | Cregg | G05B 15/02 700/275 |
| 2015/0234369 | A1* | 8/2015 | Wen | G05B 15/02 700/278 |
| 2016/0168906 | A1* | 6/2016 | Mullet | E06B 9/322 700/275 |
| 2017/0350187 | A1* | 12/2017 | Hall | E06B 9/307 |

* cited by examiner

WINDOW COVERING AND SENSORS TO REDUCE CONVECTION

TECHNICAL FIELD

This invention relates generally to the field of home automation, and more specifically to automated window coverings.

BACKGROUND

Home automation is a very popular field with a broad consumer market. Automated window covering systems have been developed that operate on a wide variety of inputs to achieve a desired outcome. Some systems seek to maximize the amount of light let in through a window. Others vary the amount of sunlight admitted based on a thermostat. Others seek to provide shade while still allowing natural light to enter. Some systems operate based on geographic locations, others based on photo sensors or time of day. Many problems have been addressed by the various systems existing in the prior art, however there are yet still problems that the state of the art have not solved.

It can often be uncomfortable to sit in a drafty room. One cause of air drafts is uneven heating of air in a room by sunlight through a window. While the current state of the art has addressed problems ranging from temperature control to brightness control, there is still a need to address the problem of preventing drafts near windows.

SUMMARY OF THE INVENTION

An automated window covering system is disclosed that overcomes or improves upon the limitations discussed above. In general, the automated window covering system includes a window covering that is adjusted by a microcontroller via a motor. The microcontroller instructs the moter to adjust the window covering based on temperature information received from two temperature sensors. When a temperature gradient is detected that results in convection in front of the window, the window covering is adjusted to reduce convection. Thus, the window covering is capable of resolving the draft-causing temperature gradient while still allowing natural light into the room.

In one embodiment, a system to reduce drafts in front of a window is described. The system includes a window covering and a motor and gearbox that adjust the window covering. The system also includes a first temperature sensor, a second temperature sensor, and a microcontroller networked to the motor and temperature sensors. The first temperature sensor is positioned above the window covering within a thermal convection zone of a window associated with the window covering, and the second temperature sensor is positioned below the window covering within the thermal convection zone. The microcontroller instructs the motor to adjust the window covering based on a temperature gradient from the first temperature sensor to the second temperature sensor.

In another embodiment, a method to reduce drafts in front of a window is also described. The method includes measuring a first temperature above a window covering within a thermal convection zone of a window associated with the window covering, measuring a second temperature below the window covering within the thermal convection zone, and calculating a temperature gradient based on the first and second temperatures. The method also includes adjusting the window covering based on the temperature gradient.

BRIEF DESCRIPTION OF THE DRAWINGS

A more particular description of the invention briefly described above is made below by reference to specific embodiments. Several embodiments are depicted in drawings included with this application, in which.

DETAILED DESCRIPTION

A detailed description of the claimed invention is provided below by example, with reference to embodiments in the appended figures. Those of skill in the art will recognize that the components and steps of the invention as described by example in the figures below could be arranged and designed in a wide variety of different configurations without departing from the substance of the claimed invention. Thus, the detailed description of the embodiments in the figures is merely representative of embodiments of the invention, and is not intended to limit the scope of the invention as claimed.

The descriptions of the various embodiments include, in some cases, references to elements described with regard to other embodiments. Such references are provided for convenience to the reader, and are not intended to limit the described elements to only the features described with regard to the other embodiments. Rather, each embodiment is distinct from each other embodiment.

Throughout the detailed description, various elements are described as "off-the-shelf." As used herein, "off-the-shelf" means "pre-manufactured" and/or "pre-assembled."

In some instances, numerical values are used to describe features such as temperature gradients. Though precise numbers are used, one of skill in the art recognizes that small variations the precisely stated values do not substantially alter the function of the feature being described. In some cases, a variation of up to 50% of the stated value does not alter the function of the feature. Thus, unless otherwise stated, precisely stated values should be read as the stated number, plus or minus a standard variation common and acceptable in the art.

Figure 1:
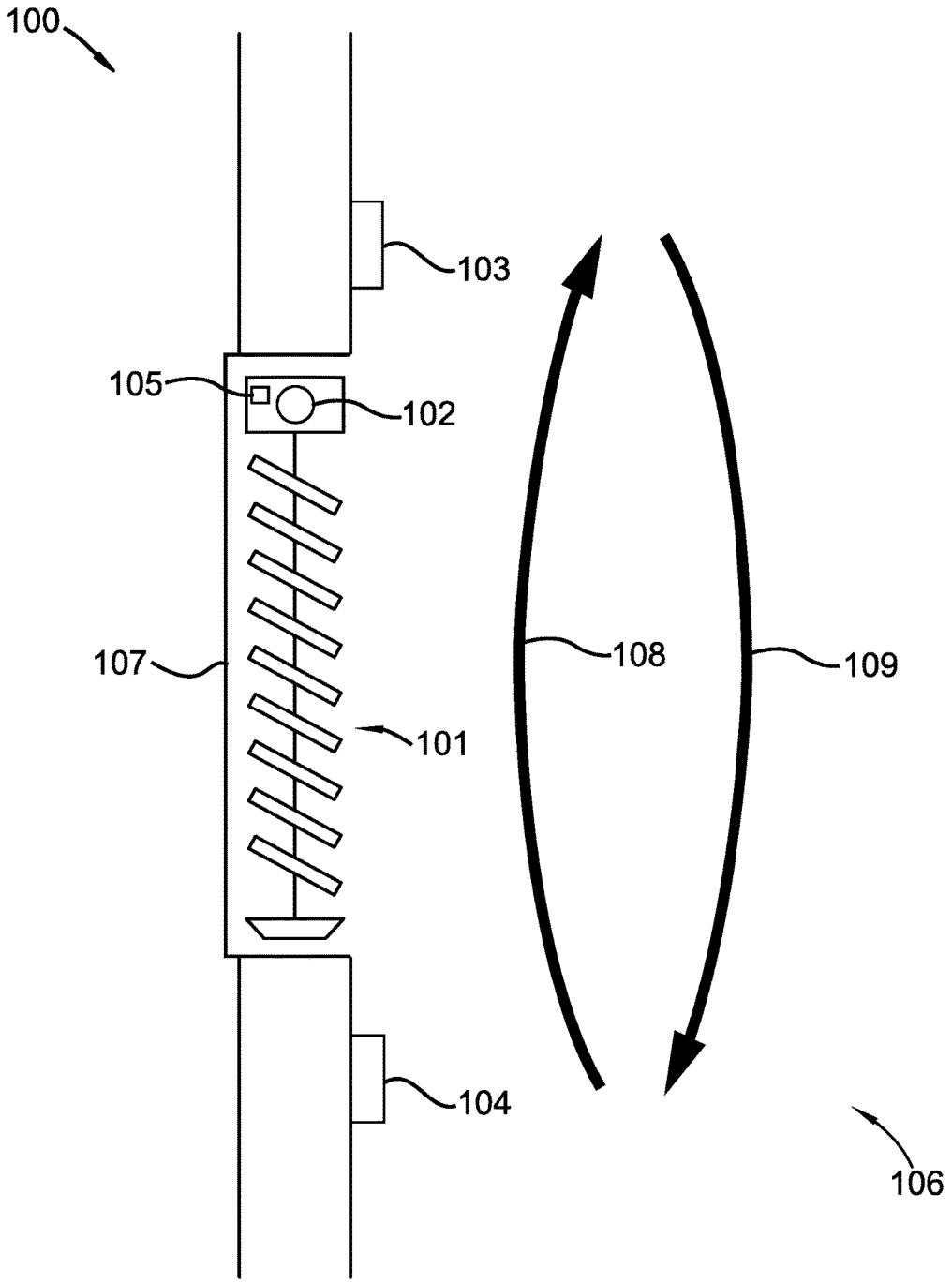
FIG. 1 depicts one embodiment of a system to reduce drafts in front of a window.

FIG. 1 depicts one embodiment of a system to reduce drafts in front of a window. System 100 includes window covering 101, motor and gearbox 102 that adjust the window covering, first temperature sensor 103, second temperature sensor 104, and microcontroller 105. First temperature sensor 103 is positioned above window covering 101 within thermal convection zone 106 of window 107 associated with window covering 101. Second temperature sensor 104 is positioned below window covering 101 within thermal convection zone 106. Microcontroller 105 is networked to motor 102, first temperature sensor 103, and second temperature sensor 104. Microcontroller 105 instructs motor 102 to adjust window covering 101 based on a temperature gradient from first temperature sensor 103 to second temperature sensor 104.

Window 107 is an exterior window between a room of a structure and an outside environment around the structure. Window 107 is generally made of glass or any of a variety of clear plastic composite materials. As such, window 107 allows sunlight from the outside environment, either direct from the sun or reflected off of other surfaces, to enter the room. Thermal convection zone 106 is on the room side of window 107. Zone 106 exists as a result of a temperature gradient caused by uneven heating of air by sunlight. Sunlight enters through window 107 and heats air in zone 106. The density of the air being heated decreases and a boyant force causes heated air 108 to rise. Heated air 108 displaces cool air 109 above window covering 101. Once the heated air has risen beyond exposure to the sunlight, the heated air begins to cool. As the air cools, it descends, eventually returning below window covering 101 where it is reheated by the sunlight and moved upward once again by the boyant force. The process repeats as heated air 108 rises and cool air 109 descends.

Window covering 101 is any of a variety of window shades or window blinds, including pleated shades, cellular shades, roller shades, sheer shades, horizontal blinds, and verticle blinds. Similarly, motor and gearbox 102 are any of a variety of off-the-shelf motors and gearboxes. In some embodiments, motor and gearbox 102 are battery-powered. In other embodiments, motor and gearbox 103 are solar-powered. In yet other embodiments, motor and gearbox 103 are powered by AC mains power, and include an AC to DC power converter.

Temperature sensors 103, 104 are any of a variety of thermocouples, thermistors, or resistance temperature detectors (RTD's). Temperature sensors 103, 104 are, in some embodiments, battery-powered. In other embodiments, temperature sensors 103, 104 are coupled to motor and gearbox 102 and powered via the same power source that powers motor and gearbox 102. In yet other embodiments, temperature sensors 103, 104 are solar-powered. And in other embodiments, temperature sensors 103, 104 are coupled separately to AC mains power, and include AC to DC power converters. Temperature sensors 103, 104 communicate with microcontroller 105 in a variety of ways. For example, in one embodiment, temperature sensors 103, 104 communicate with microcontroller 105 via a wired connection. In another embodiment, temperature sensors 103, 104 communicate with microcontroller 105 wirelessly via any of a variety of wireless protocols, such as Wifi, Bluetooth, Z-Wave, Zigebee, or SureFi (a proprietary, frequency-hopped wireless network on the 902-928 MHz ISM band).

Microcontroller 105 is any of a variety of off-the-shelf microcontrollers. Microcontroller 105 instructs motor 102 to adjust window covering 101 based on a temperature gradient from sensor 103 to sensor 104. Adjusting window covering 101 varies the amount and angle of sunlight that enters a room. By controlling the amount and angle of the sunlight, system 100 influences heating of the air in thermal convection zone 106. For example, in one embodiment, as depicted in FIG. 1, window covering 101 is a set of horizontal window blinds. Window covering 101 is tilted so that sunlight is directed to air below window covering 101, heating the air. Initially, air temperatures above and below window covering are approximately equal, so that no convection occurs. Temperature sensors 103, 104 continuously measure the air temperatures above and below window covering 101, respectively, and transmit the temperatures to microcontroller 105. As the air below window covering 101 is heated, microcontroller 105 detects a temperature gradient between the air above and below window covering 101. Based on the temperature gradient, microcontroller 105 instructs motor and gearbox 102 to adjust the tilt of window covering 101 to counteract the temperature gradient. In some cases that means tilting the window covering 101 so that air above window covering 101 is heated. In other cases, that means closing window covering 101 until a temperature equilibrium between the air above and below window covering 101 is reached.

In one embodiment, window covering 101 is a set of vertical window blinds. Window covering 101 is tilted open, and because of the positioning of the sun, light passes through window 107 and heats the air below window covering 101. As in the embodiment described above, temperature sensors 103, 104 continuously measure the air temperatures above and below window covering 101, respectively, and transmit the temperatures to microcontroller 105. As the air below window covering 101 is heated, microcontroller 105 detects a temperature gradient between the air above and below window covering 101. Based on the temperature gradient, microcontroller 105 instructs motor and gearbox 102 to tilt window covering 101 closed, at least until a thermal equilibrium is reached between the air above and below window covering 101.

In another embodiment, window covering 101 is a set of roller shades. Window covering 101 is open, and because of the positioning of the sun, light passes through window 107 and heats the air below window covering 101. As with the other embodiments described above, a temperature gradient is detected, and microcontroller 105 instructs motor and gearbox 102 to tilt window covering 101 closed, at least until a thermal equilibrium is reached between the air above and below window covering 101.

A threshold temperature gradient sufficient to trigger microcontroller 105 to adjust window covering 101 is, in some embodiments, pre-programmed in microcontroller 105. The threshold gradient ranges, in various embodiments, from 0.25° F. to 5° F. In other embodiments, the threshold gradient ranges from 1° F. to 3° F. In one specific embodiment, the threshold gradient is 2° F. In yet other embodiments, the threshold gradient is programmable by a user. This embodiment is particularly beneficial because the magnitude and perceptibility of convection varies from room-to-room, structure-to-structure, and is also highly user-dependent. In some such embodiments where the threshold gradient is programmable, system 100 includes an airflow sensor to detect convection, and microcontroller 105 correlates an amount of convection with a temperature gradient. A user interface then conveys to the user a variety of levels of convection, and the user selects the threshold temperature gradient by selecting a desired level of convection.

Figure 2A:
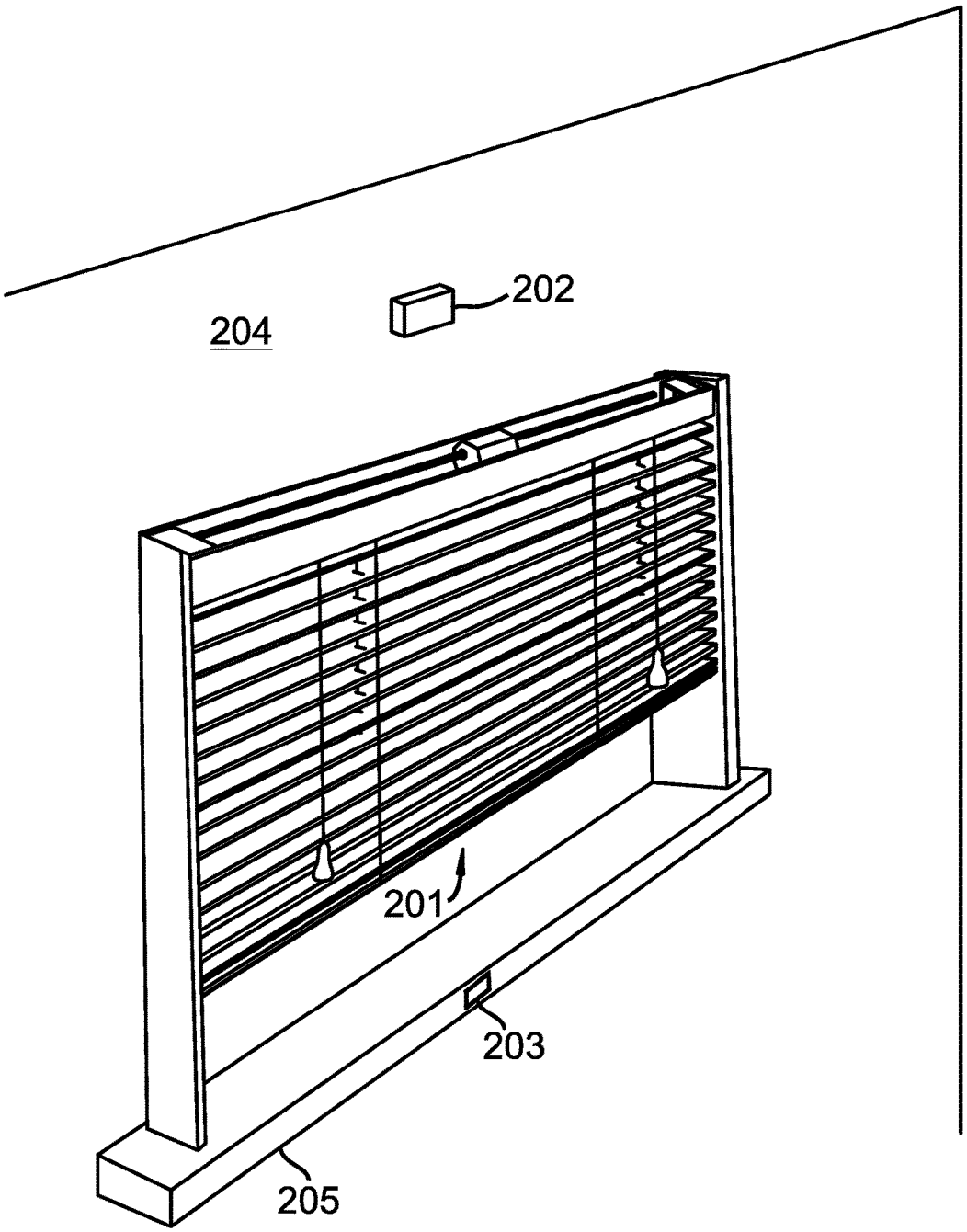
FIGS. 2A-D depict various embodiments of an automated window covering system with alternative temperature sensor locations.
Figure 2B:
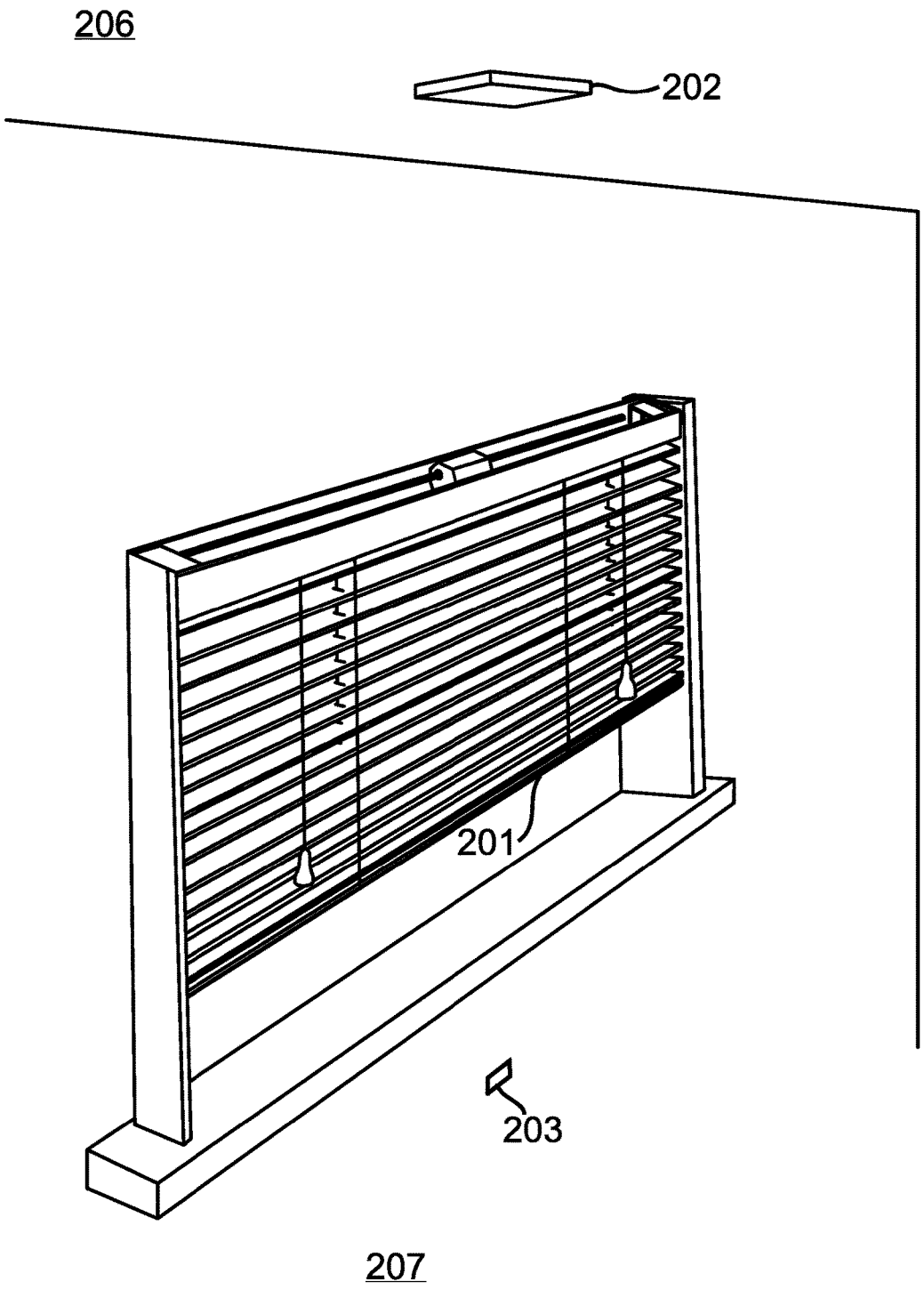
Figure 2C:
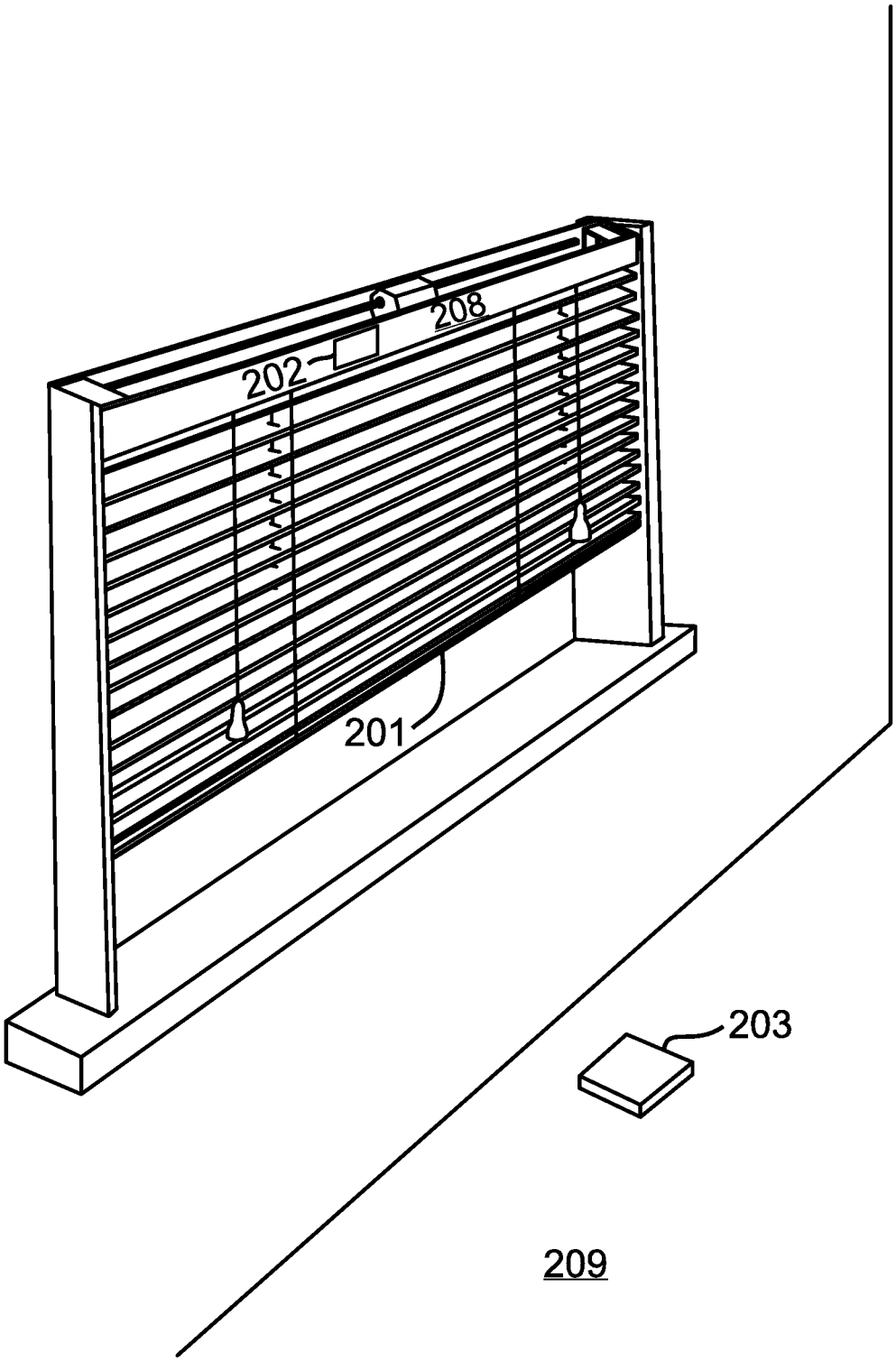
Figure 2D:
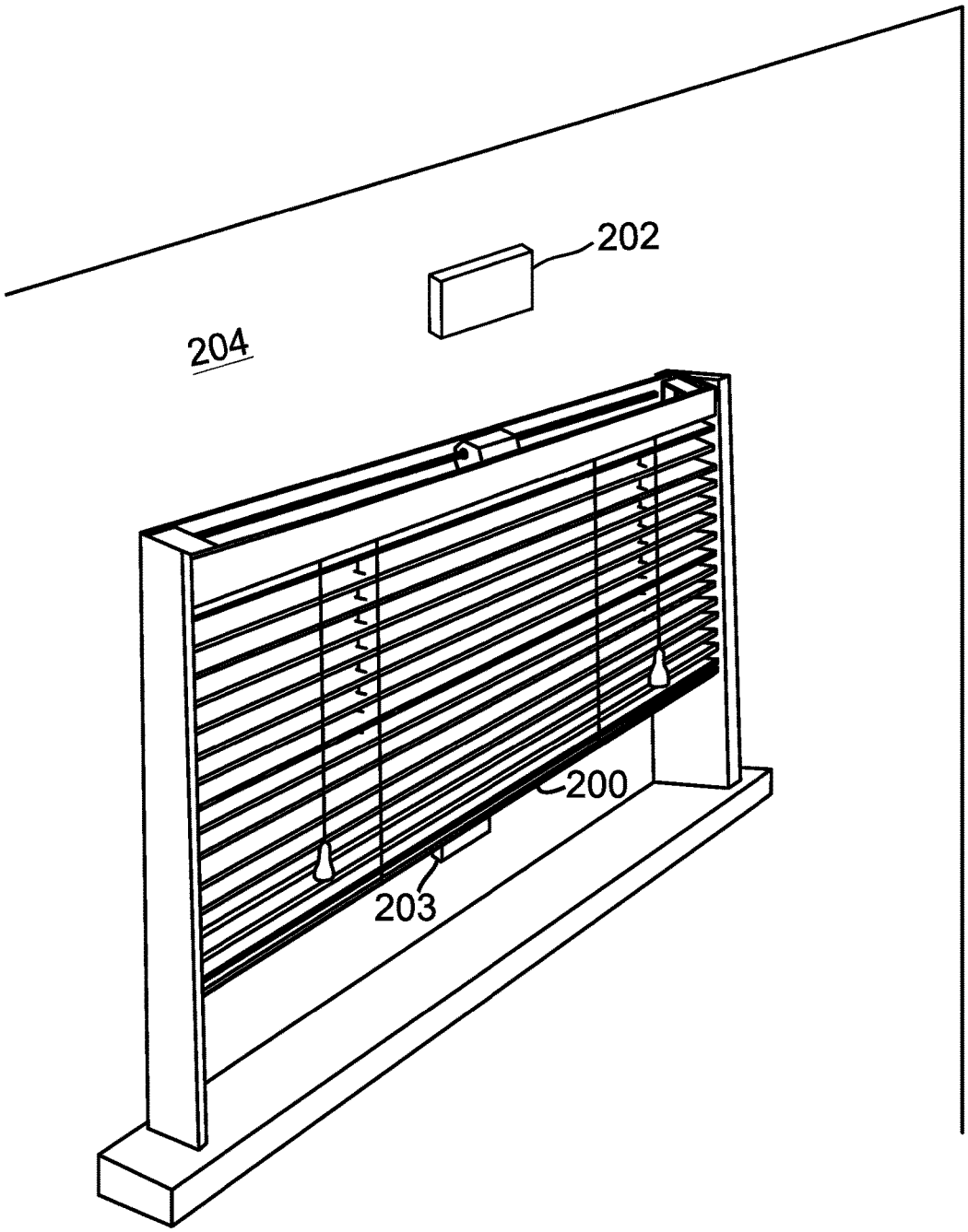

FIGS. 2A-D depict various embodiments of an automated window covering system with alternative temperature sensor locations. In general, FIGS. 2A-D include window covering 201, first temperature sensor 202, and second temperature sensor 203. As depicted in FIG. 2A, sensor 202 is mounted to verticle room wall 204 above window covering 201, and sensor 203 is mounted to window sill 205 beneath window covering 201. In FIG. 2B, sensor 202 is mounted to ceiling 206 of a room associated with window covering 201. Sensor 203 is mounted to vertical wall 207 beneath window covering 201. In FIG. 2C, sensor 202 is mounted to headrail 208 of window covering 201, and sensor 203 is mounted to floor 209 of a room associated with window covering 201. In FIG. 2D, sensor 202 is again mounted to vertical wall 204, but sensor 203 is mounted to a bottom horizontal slat of window covering 201.

With regard to the embodiments discussed above in FIGS. 2A-D, sensors 202, 203 are mounted in any of a variety of ways. In some embodiments, sensors 202, 203 are embedded into vertical walls 204, 207, ceiling 206, or the bottom horizontal slat. In other embodiments, sensors 202, 203 are mounted by one or more screws. In yet other embodiments, sensors 202, 203 are mounted using a polymer adhesive.

Figure 3:
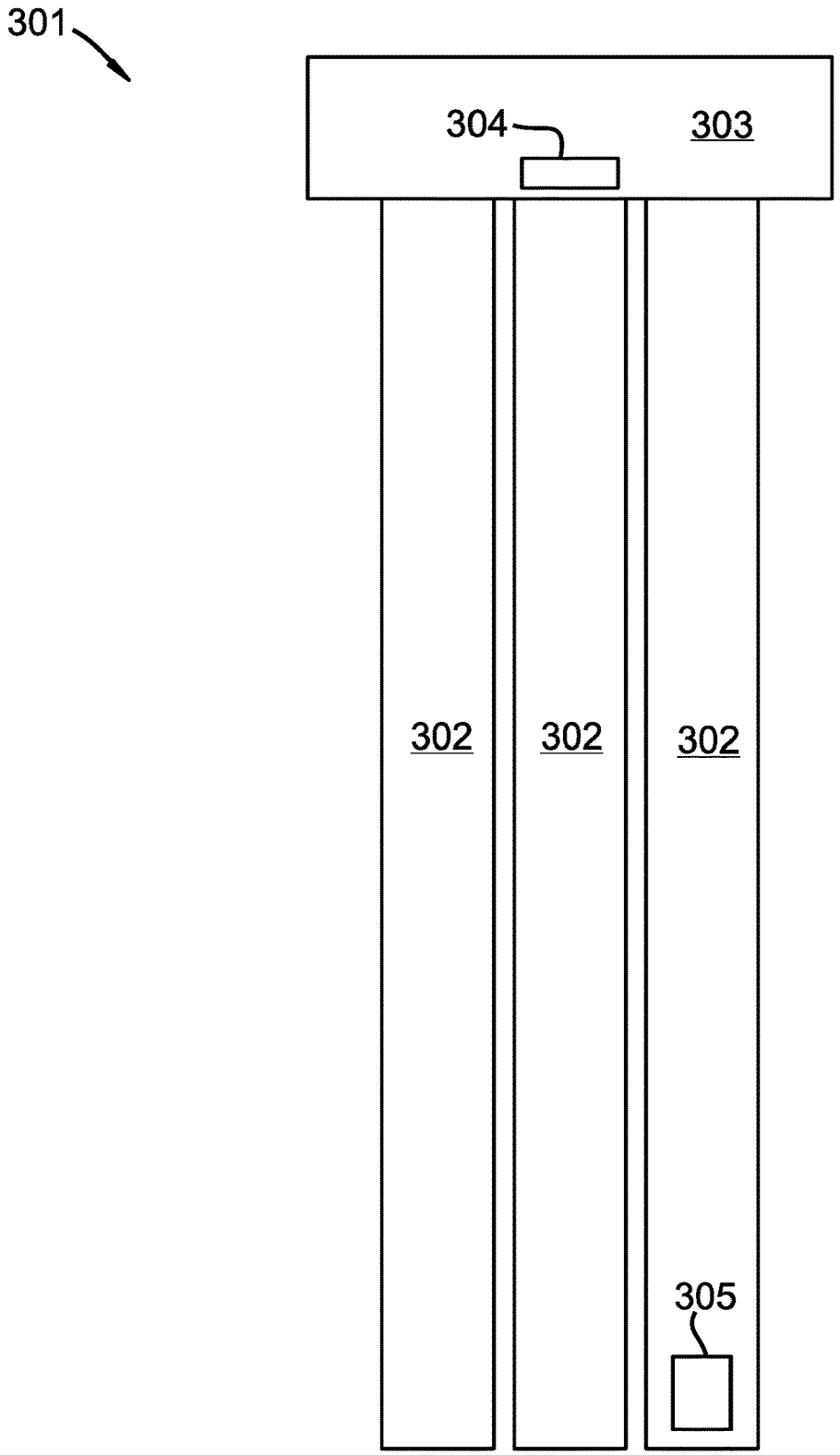
FIG. 3 depicts one embodiment of temperature sensor positioning with regard to a set of vertical window blinds, according to the claimed invention.

FIG. 3 depicts one embodiment of temperature sensor positioning with regard to a set of vertical window blinds, according to the claimed invention. Vertical blinds 301 include one or more vertical slats 302 and headrail 303. First temperature sensor 304 is mounted in headrail 303, and second temperature sensor 305 is mounted to a bottom portion of vertical slat 302.

Figure 4A:
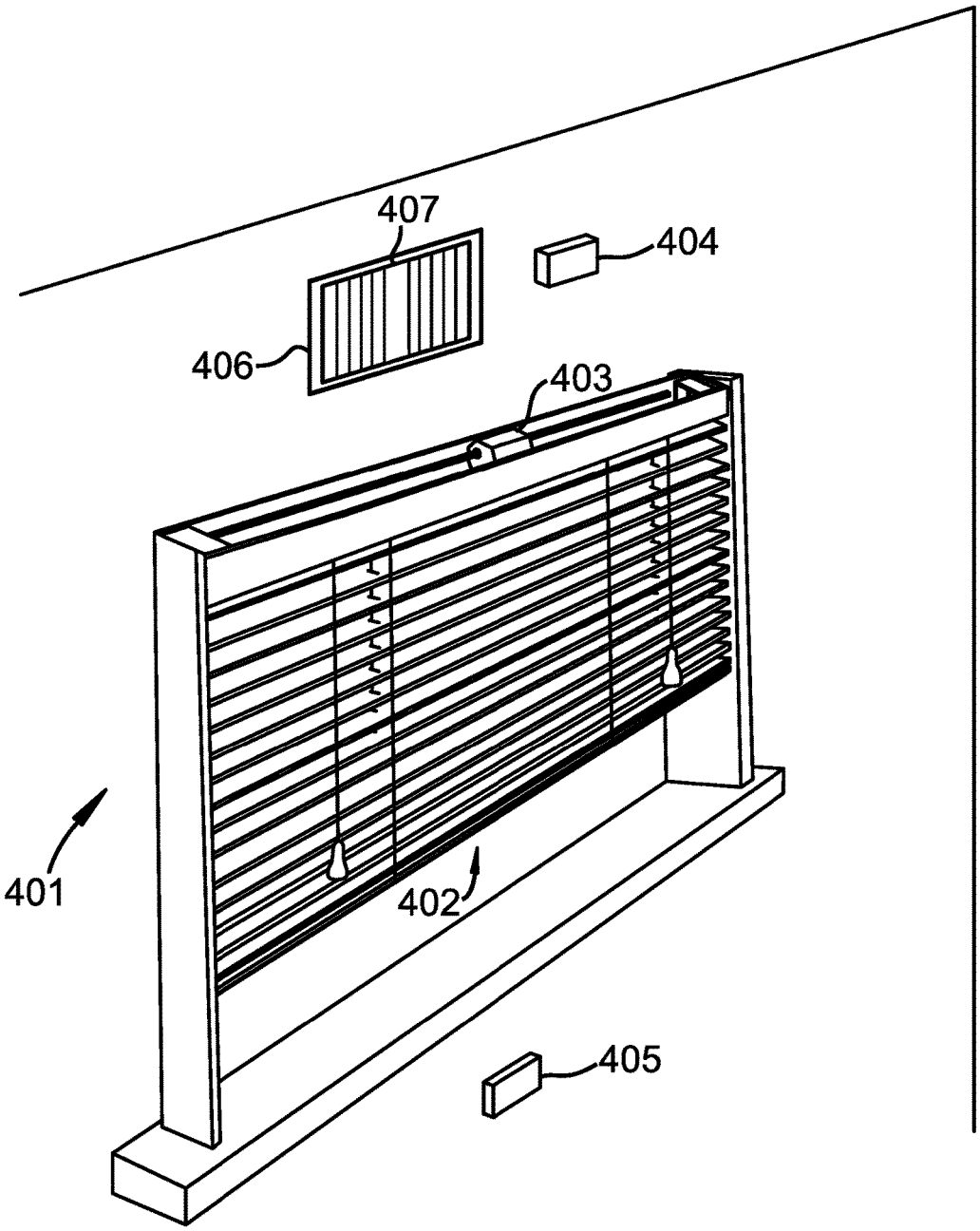
FIGS. 4A-B depict embodiments of a system to reduce drafts in front of a window including an air vent and airflow detector.
Figure 4B:
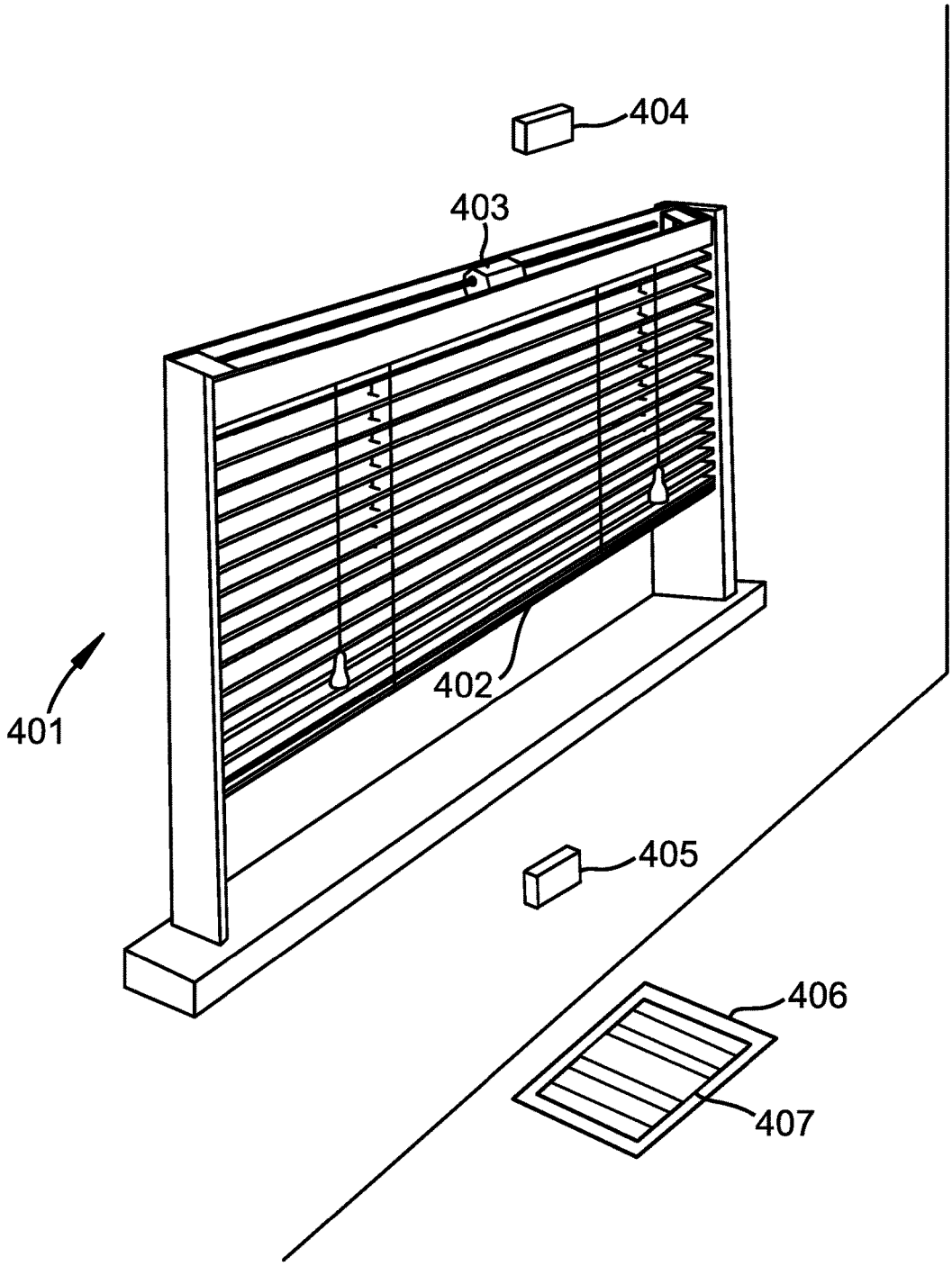

FIGS. 4A-B depict embodiments of a system to reduce drafts in front of a window including an air vent and airflow detector. FIG. 4A includes window 401, window covering 402, motor, gearbox, and microcontroller 403, first temperature sensor 404, second temperature sensor 405, air vent 406, and airflow detector 407. Air vent 406 is positioned adjacent to window covering 402. For example, as depicted, air vent 406 is positioned above window covering 402. Airplow detector 407 is mounted to air vent 406, and is networked to microcontroller 403. Microcontroller 403 instructs the motor to adjust window covering based on airflow detected by air flow detector 407.

Air flow detector 407 is any of a variety of off-the-shelf sensors capable of detecting airflow, such as an anemometer, a velocimeter, a mass flow sensor, and/or an interferometer. For example, in one specific embodiment, air flow detector 407 is a blade-style anemometer.

Air flow detector 407 is useful in counteracting the convection effects of air flowing from air vent 406. In some embodiments, cold air blows through vent 406 into the room. In many cases, the cold air is colder than a desired temperature of the room to speed cooling of the room. As the cold air flows into the room, it sinks, displacing warmer air beneath it. Because air flowing from air vent 406 has a higher speed than the air directly beneath the flow, a pressure gradient results that forces warmer air beneath the stream up. Together, these forces cause convection in front of window 401, which in some cases is uncomfortable for a person near window 401. In such embodiments, air flow detector 407 monitors the air flow and sends air flow information to microcontroller 403. Microcontroller 403 compares air flow to temperatures sensed by sensors 404, 405 and adjusts window covering 402 to minimize convection. For example, in one embodiment, window covering 402 is closed, and a temperature gradient between temperature sensors 404, 405 is less than a required threshold to adjust window covering 402. Air flow detector 407 detects air flow from air vent 406, and temperature sensor 404 measures that the air flow is a lower temperature than a room temperature. Microcontroller 403 instructs the motor to adjust window covering 402 so that sunlight is reflected towards the air flow to heat the air flow and reduce convection. The instructions to adjust window covering 402 based on the air flow override the instructions to adjust window covering 402 based on the temperature gradient.

In some embodiments, the air flow is warmer than the room temperature. For example, in one embodiment, microcontroller 403 instructs the motor to open window covering 402 to heat air in front of the window to the same temperature as air flowing through air vent 406. Microcontroller 403 then detects a temperature gradient that exceeds the threshold gradient, indicating that convection is or will be occurring. Microcontroller 403 instructs the motor to close window covering 402. The instructions to adjust window covering 402 based on the temperature gradient override the instructions to adjust window covering 402 based on the air flow.

FIG. 4B depicts an embodiment similar to the embodiment depicted in FIG. 4A, except detector 407 is mounted to air vent 406 positioned below window covering 402. In some embodiments, warm air flows from air vent 406 into the room. In such embodiments, microcontroller 403 instructs the motor to adjust window covering 402 so that sunlight is reflected towards cooler air above window covering 402, thereby reducing any draft caused by convection.

Figure 5:
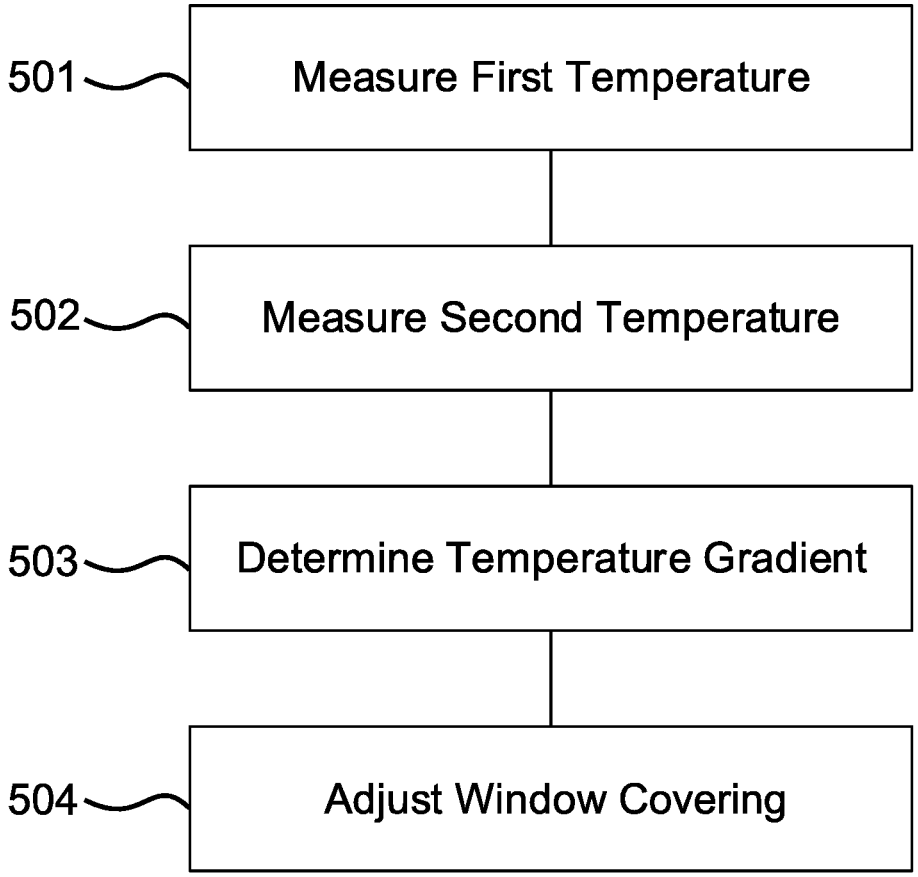
FIG. 5 depicts a method for adjusting a window covering based on a temperature gradient.

FIG. 5 depicts a method for adjusting a window covering based on a temperature gradient. Method 500 includes blocks 501 to 504. At block 501, a first temperature is measured above a window covering within a thermal convection zone of a window associated with the window covering. At block 502, a second temperature is measured below a window covering within the thermal convection zone. At block 503, a temperature gradient is determined between the first and second temperatures, and at block 504, the window covering is adjusted based on the temperature gradient.

In some embodiments, the first temperature is measured by measuring an air temperature in a zone adjacent to a vertical wall above a window associated with the window covering. In the same or other embodiments, the second temperature is measured by measuring an air temperature in a zone adjacent to a vertical wall below a window associated with the window covering. In other embodiments, the second temperature is measured by measuring an air temperature in a zone adjacent to a bottom portion of the window covering.

Method 500 is accomplished, in some embodiments, by the systems depicted in FIGS. 1-4. However, in other embodiments, other systems are used to accomplish method 500. For example, in one embodiment, a single temperature sensor using laser interferometry is used to measure the first and second temperatures. In the same or other embodiments, the temperature gradient is determined at a thermostat, and instructions to adjust the blinds are relayed to the window blind motor via a cloud computing network. In some embodiments, a user is notified of the temperature gradient, and the user manually performs block, 504 by manually adjusting the window covering or manually triggering a motor to adjust the window covering.

Figure 6:
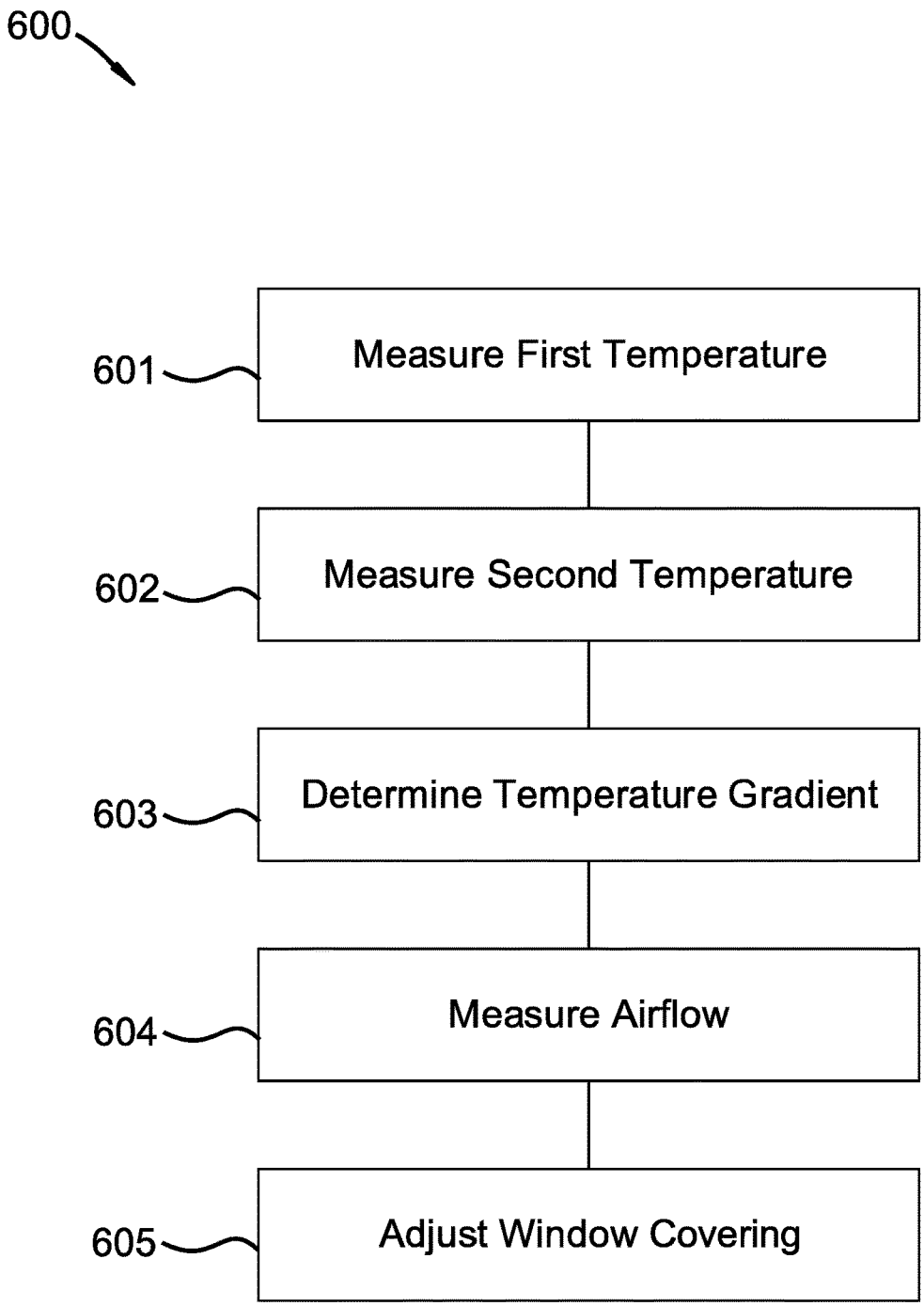
FIG. 6 depicts a method for adjusting a window covering based on at least one of a temperature gradient or airflow.

FIG. 6 depicts a method for adjusting a window covering based on at least one of a temperature gradient or airflow. Method 600 includes blocks 601-605. Blocks 601-603 and 605 are similar to blocks 501-504 described above, respectively. However, method 600 additionally includes block 604. At block 604, airflow is measured from a vent adjacent to the window covering. At block 605, in addition to, or as an alternative to adjusting the window covering based on the temperature gradient, the window covering is adjusted based on the airflow. In some embodiments, instructions to adjust the window covering based on the temperature gradient conflicts with the instructions to adjust the window covering based on the airflow. When the two sets of instructions differ, one set of instructions takes priority over the other, and the window covering is adjusted based on the prioritized instructions. For example, in some embodiments, such as is described with regard to FIGS. 4A-B, adjusting the window blinds based on the airflow overrides the adjustment based on the temperature gradient. In other embodiments, the instructions to adjust the window covering based on temperature gradient override the instructions to adjust the window covering based on airflow.

Figure 7:
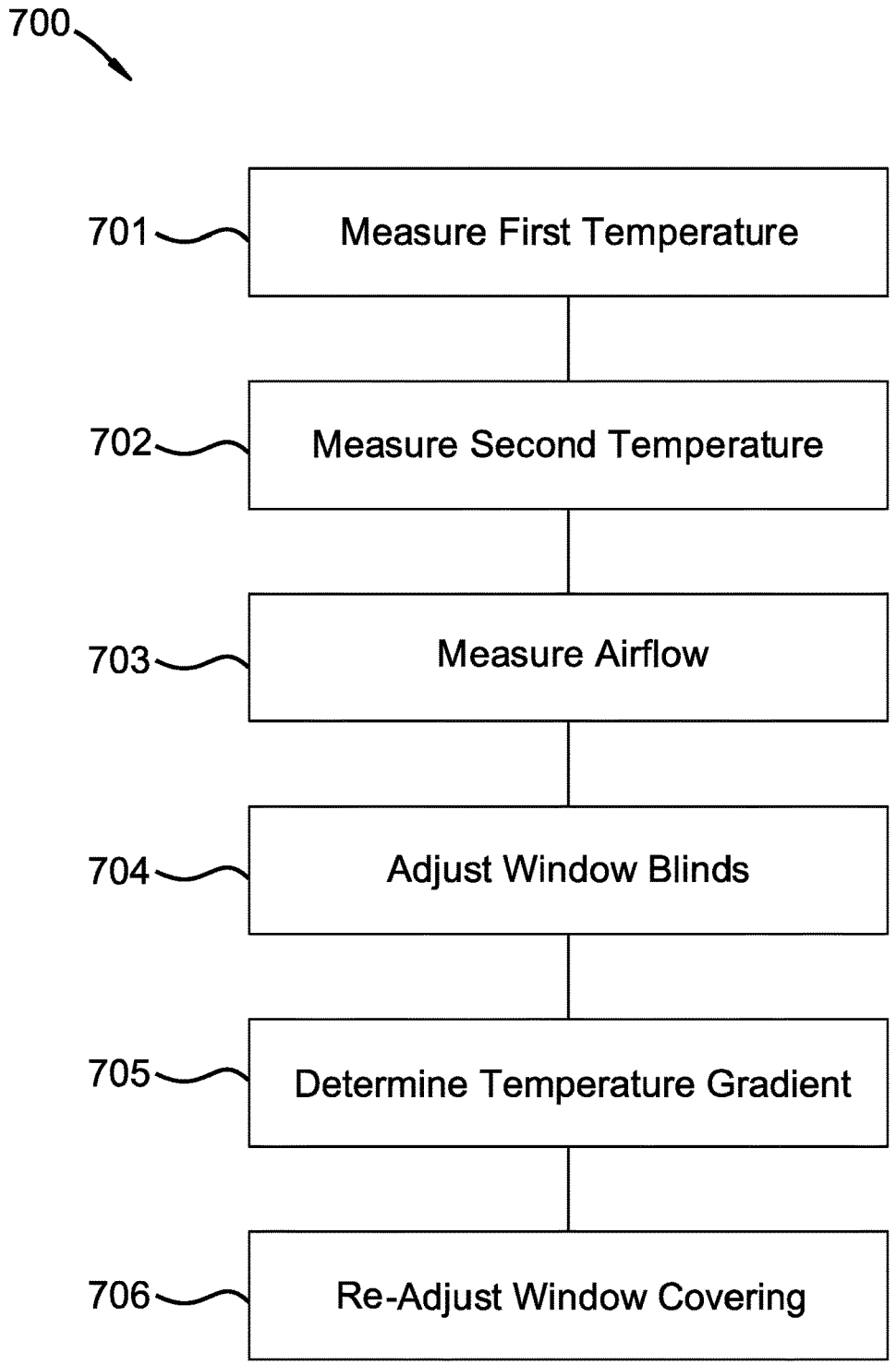
FIG. 7 depicts a method for adjusting a window covering based on airflow and re-adjusting the window covering based on a temperature gradient.

FIG. 7 depicts a method for adjusting a window covering based on airflow and re-adjusting the window covering based on a temperature gradient. Method 700 includes blocks 701-706. Blocks 701-705 are similar to those described above with regard to FIGS. 5-6. However, at Block 706, instructions to adjust the window covering based on the detected airflow are overridden, and the window covering is readjusted based on the temperature gradient. For example, method 700 is useful in embodiments such as those described with regard to FIG. 4A where warm air flows from a vent above the window covering.

Figure 8:
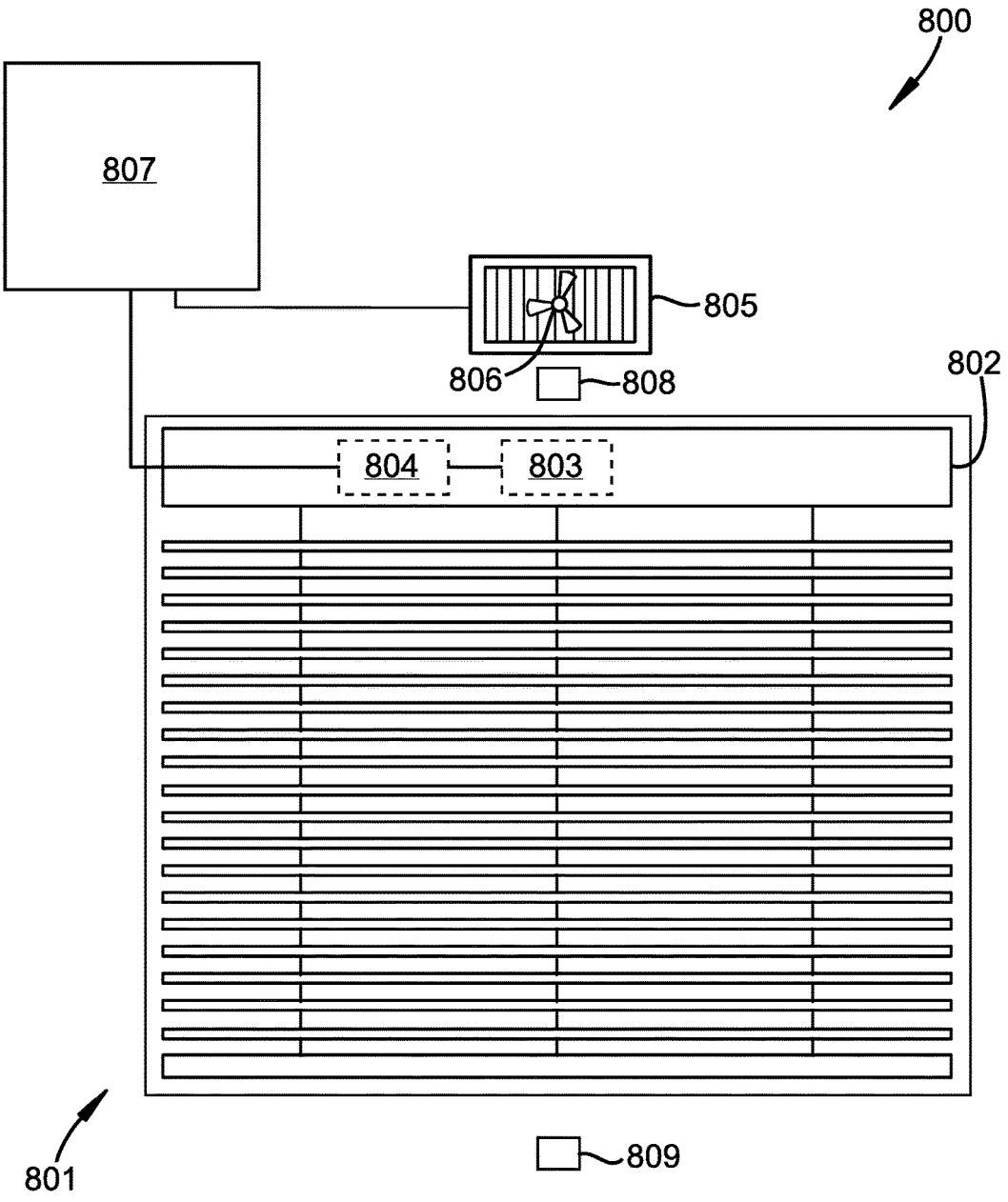
FIG. 8 depicts an embodiment of a window covering and vent coupled to an HVAC system.

FIG. 8 depicts an embodiment of a window covering and vent coupled to an HVAC controller. System 800 includes window 801, window covering 802, motor and gearbox 803, microcontroller 804, air vent 805, airflow detector 806, HVAC controller 807, and temperature sensors 808, 809. As depicted, microcontroller 804 is networked to HVAC controller 807. In some such embodiments, microcontroller 804 instructs HVAC controller 807 to adjust an air speed from the vent based on at least one of a temperature gradient between temperature sensors 808, 809, and an airflow detected by airflow detector 806. In the same or other such embodiments, such as when a first temperature measured by temperature sensor 808 is lower than a second temperature measured by temperature sensor 809, microcontroller 804 instructs HVAC controller 807 to adjust a temperature of the airflow to match the second temperature.

In the depicted embodiment, airflow detector 806 is positioned outside air vent 805. However, in some embodiments, airflow detector 806 is within air vent 805 behind air vent slats.

Window 801, window covering 802, motor and gearbox 803, microcontroller 804, air vent 805, airflow detector 806, and temperature sensors 808, 809 are similar to corresponding components described above with regard to FIGS. 1-7. HVAC controller 807 is any of a variety of off-the-shelf HVAC controllers. For example, in one embodiment, HVAC controller 807 is a central controller networked to one or more end-node thermostats. In another embodiment, HVAC controller 807 is an end-node thermostat.

As described above with regard to FIG. 4, the airflow can create a significant enough pressure gradient to cause or increase convection. Thus, when a temperature gradient is measured by microcontroller 804, maintaining a slower air speed of the airflow reduces potential convections. Additionally, warming the airflow slightly by tilting window covering 802 to reflect sunlight towards the airflow further reduces convection. Alternatively, adjusting the temperature of the airflow to match the temperature of the air below window 801 further reduces mixing caused by falling cool air and rising warm air.

Figure 9:
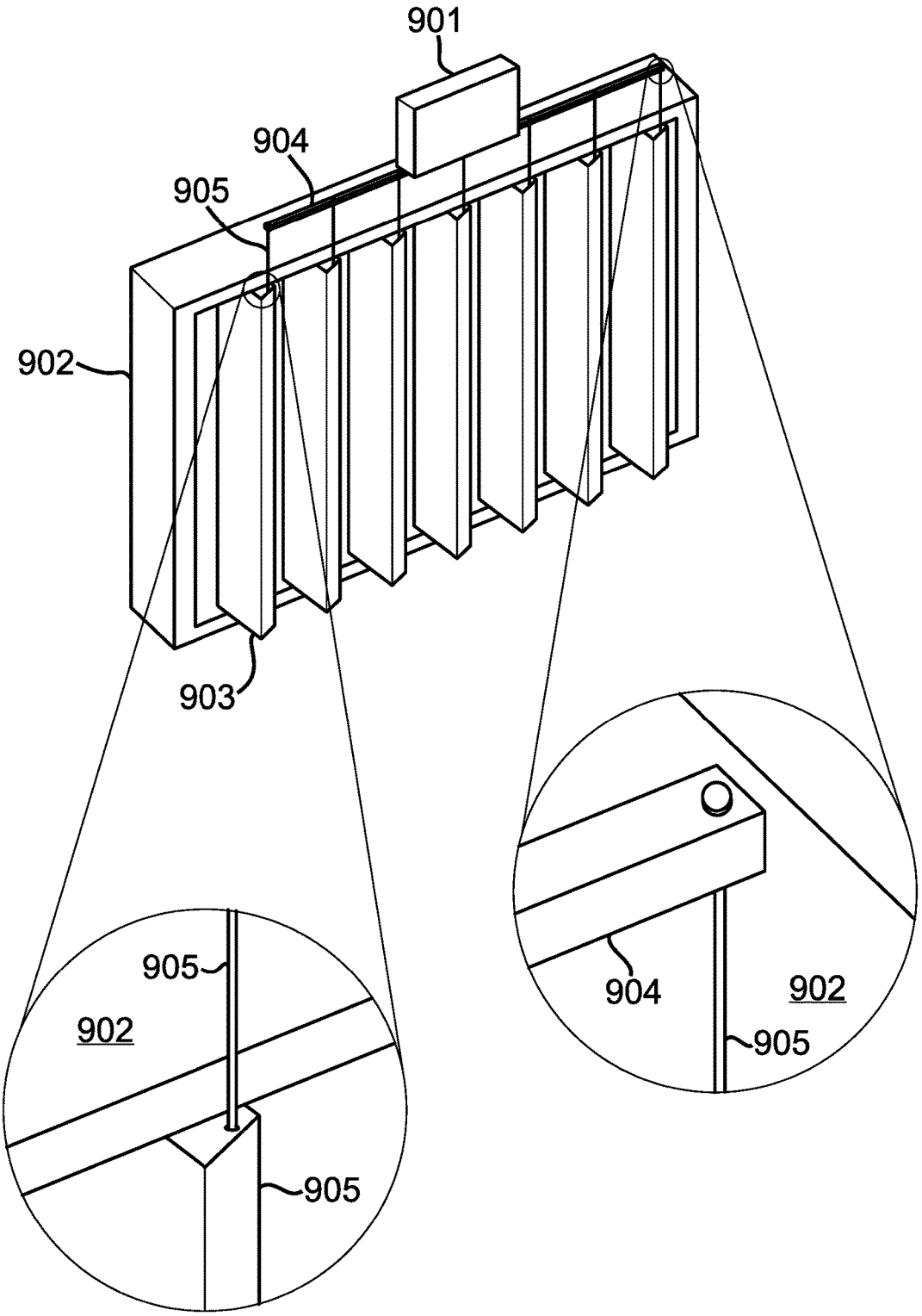
FIG. 9 depicts one embodiment of a motor for adjusting air vent slats.

FIG. 9 depicts one embodiment of a motor for adjusting air vent slats. System 900 includes motor 901, vent housing 902, and vent slats 903. Motor 901 is coupled to slats 903 via arm 904 and pivot rods 903. Pivot rods 905 extend from slats 903 through arm 904. Motor 901 slides arm 904 back and forth, forcing slats 903 back and forth via rods 905.

Figure 10A:
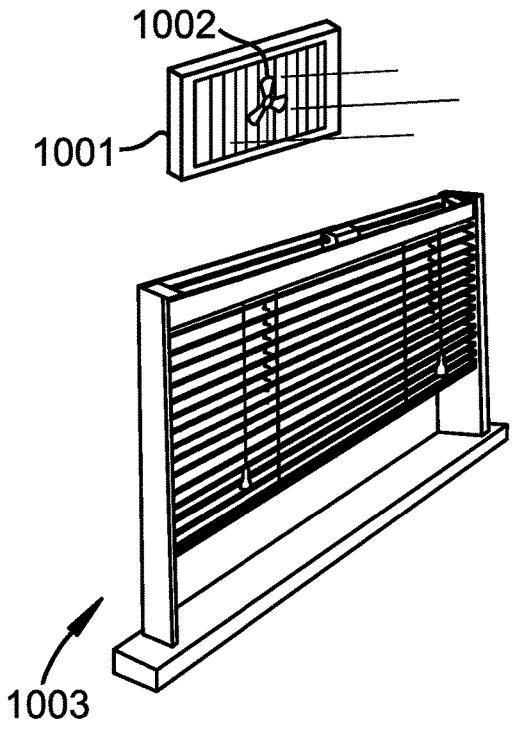
FIGS. 10A-D depict various embodiments of directional vents according to the claimed invention.

FIGS. 10A-D depict various embodiments of directional vents according to the claimed invention. FIG. 10A depicts air vent 1001, including airflow detector 1002, positioned above window 1003. Airflow detector 1002 and window 1003 are similar to thos described above with regard to FIGS. 1-8. Air vent 1001 includes adjustable slats to vary the direction of air flowing through vent 1001. Though not depicted, air vent 1001 includes any of a variety of off-the-shelf motors coupled to the adjustable slats, and further coupled to a microcontroller (not depicted, though similar to other FIGs. described above). The microcontroller instructs the motor to adjust the slats based on at least one of a temperature gradient from above window 1003 to below window 1003 and an airflow detected by airflow detector 1002.

In the depicted embodiment, air vent 1001 is positioned above window 1003. However, in other embodiments, air vent 1001 is positioned in a ceiling above window 1003, on a vertical wall below window 1003, or in a floor below window 1003.

Figure 10B:
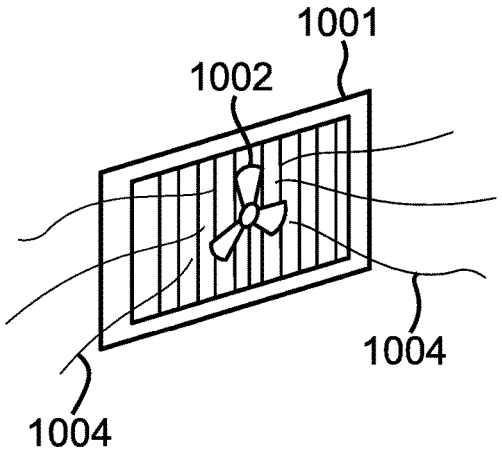

As depicted in FIG. 10B, in some embodiments, the slats direct airflow 1004 towards both sides of air vent 1001. In some such embodiments, it is beneficial to position airflow detector 802 behind the slats so that the directioning of the airflow does not affect an air spead measured by airflow detector 802. Directing airflow 1004 to both sides of air vent 1001 helps to reduce a pressure gradient caused by airflow 1004 directly above window 1003.

Figure 10C:
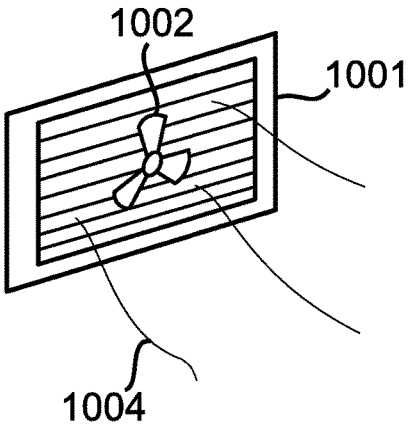
Figure 10D:
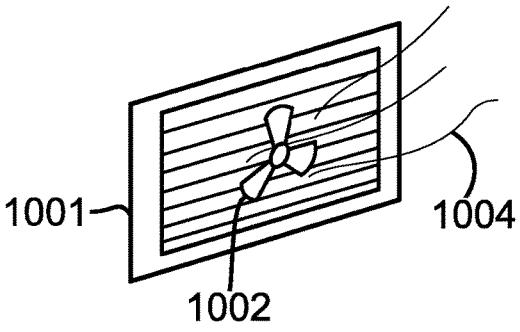

In FIG. 10C, the slats direct airflow 1004 below air vent 1001. However, in embodiments, where air vent 1001 is positioned in a floor or ceiling, airflow 1004 is directed away from and towards window 1003, respectively. Conversely, as depicted in FIG. 10D, the slats direct airflow 1004 above air vent 1001, or towards or away from window 1003 when air vent 1001 is positioned in a floor or ceiling, respectively. Directing airflow 1004 towards window 1003 helps warm airflow 1004, and directing airflow 1004 away from window 1003 helps reduce the influence of a pressure gradient on convection when an air temperature on an opposite side of window 1003 from air vent 1001 is equal to a temperature of airflow 1004.

Figure 11:
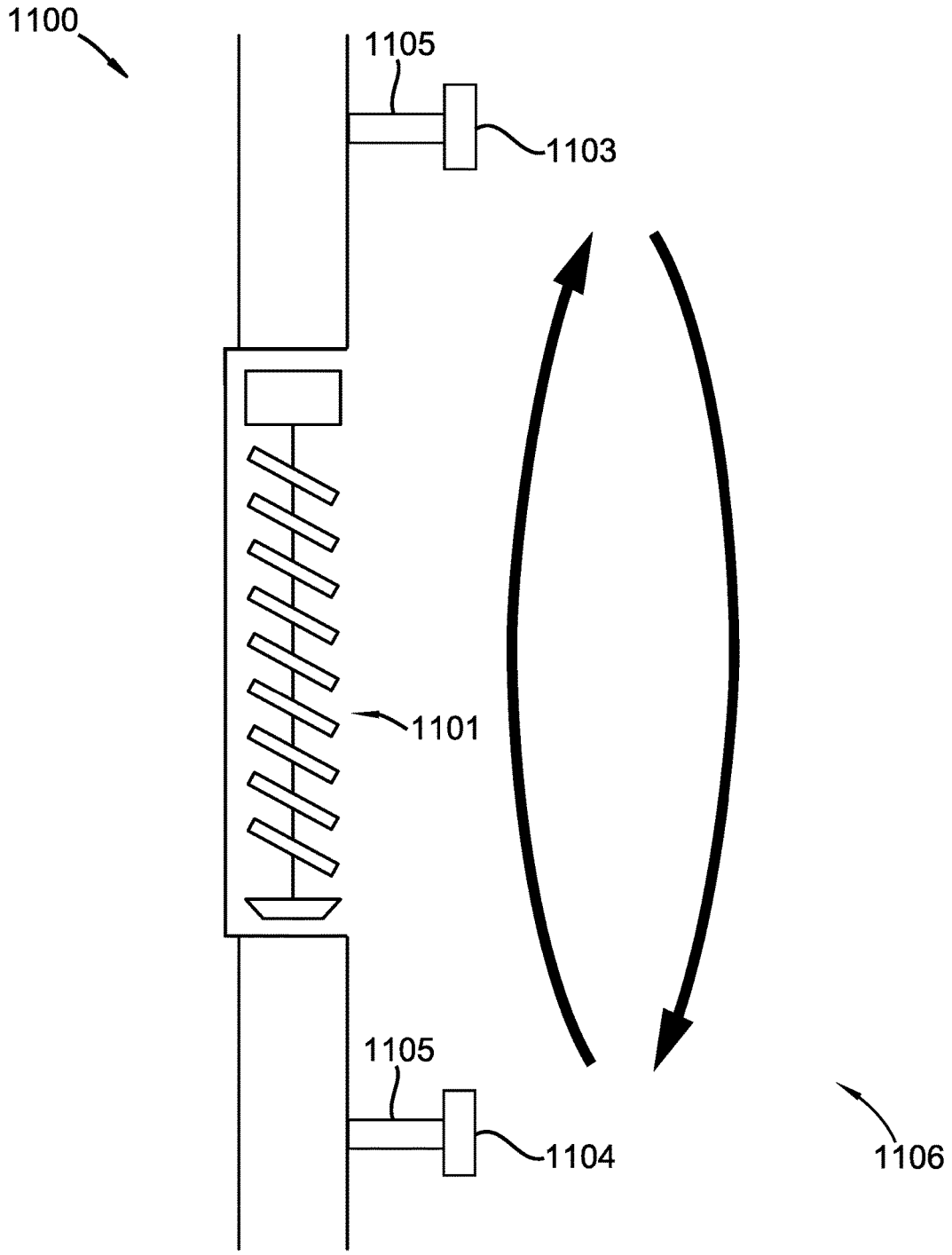
FIG. 11 depicts an alternative embodiment of temperature sensors positioned in a convection zone.

FIG. 11 depicts an alternative embodiment of temperature sensors positioned in a convection zone. System 1100 includes window covering 1101, temperature sensors 1103, 1104, and convection zone 1106. Temperature sensors 1103, 1104 are positioned above and below window covering 1101, respectively, and extending into convection zone 1106 by standoffs 1105.

Figure 12:
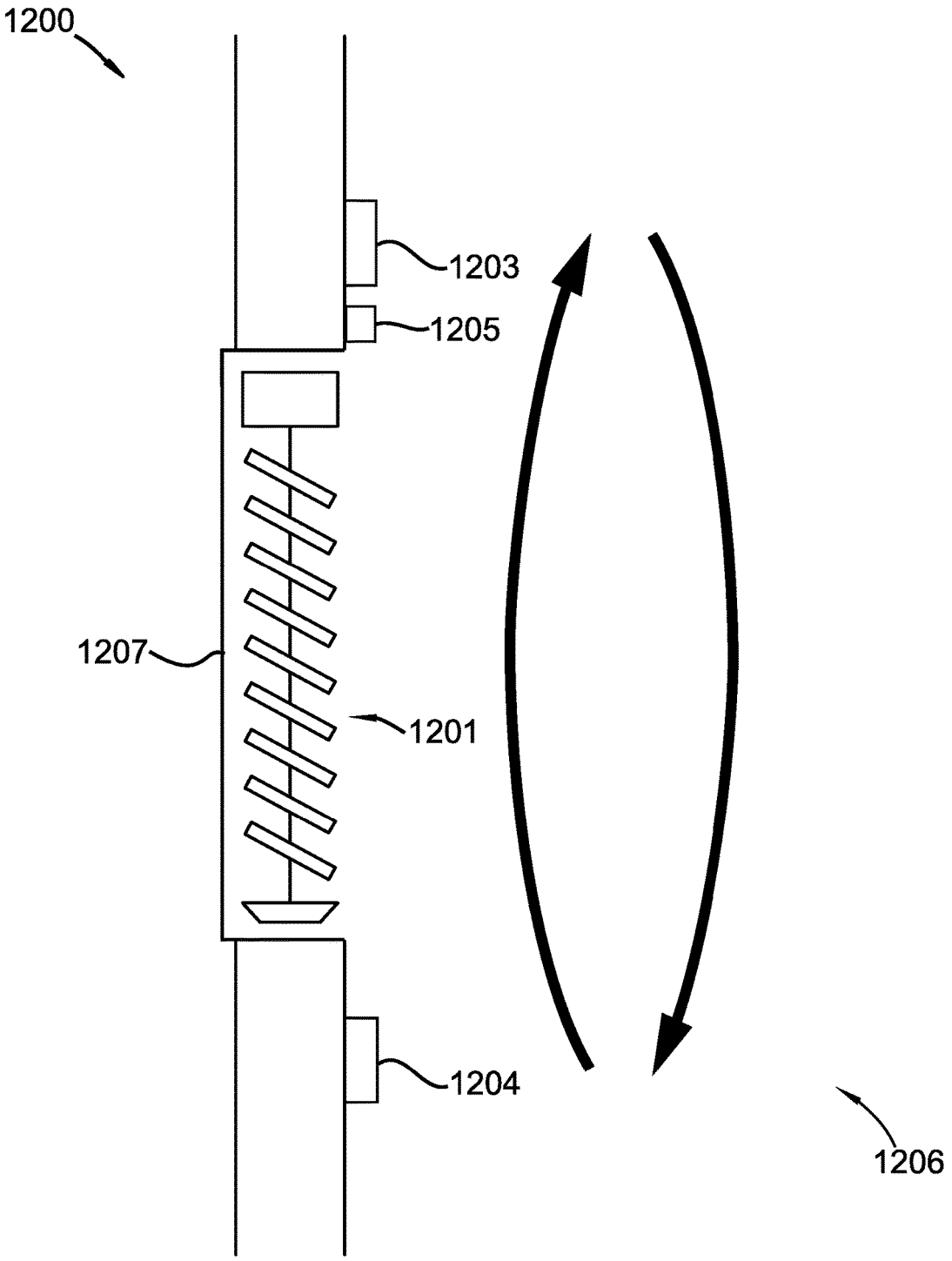
FIG. 12 depicts an embodiment of a window covering system that includes an air flow sensor for detecting convection.

FIG. 12 depicts an embodiment of a window covering system that includes an air flow sensor for detecting convection. System 1200 includes window covering 1201, temperature sensors 1203, 1204, air flow sensor 1205, convection zone 1206, all associated with window 1207. Air flow sensor 1205 is positioned to detect convection around window 1207. In some embodiments, air flow sensor 1205 is a hot wire anemometer. In the same or other embodiments, though not depicted, air flow sensor 1205 is extended more fully into convection zone 1206 by a standoff.

The invention claimed is:

1. A system comprising:

a window covering;

a motor and gearbox that adjust the window covering;

a first temperature sensor positioned above the window covering within a thermal convection zone of a window associated with the window covering;

a second temperature sensor positioned below the window covering within the thermal convection zone;

a microcontroller networked to the motor and the first and second temperature sensors, wherein the microcontroller instructs the motor to adjust the window covering based on a temperature gradient from the first temperature sensor to the second temperature sensor, and an airflow detector networked to the microcontroller and mounted to an air vent positioned adjacent to the window covering, wherein the microcontroller instructs the motor to adjust the window covering based on airflow detected by the airflow detector.

2. The system of claim 1, wherein the first temperature sensor is mounted to a ceiling of a room associated with the window covering or a vertical wall of the room above the window covering.

3. The system of claim 1, wherein the second temperature sensor is mounted to a window sill beneath the window covering, a vertical wall beneath the window covering, or a floor of a room associated with the window covering.

4. The system of claim 1, wherein the second temperature sensor is mounted to a bottom horizontal slat of the window covering.

5. The system of claim 1, wherein the second temperature sensor is mounted to a bottom portion of a vertical slat of the window covering.

6. The system of claim 1, wherein the airflow detector is mounted to an air vent positioned above the window covering.

7. The system of claim 1, wherein the airflow detector is mounted to an air vent positioned below the window covering.

8. The system of claim 1, wherein the instructions to adjust the window covering based on airflow override the instructions to adjust the window covering based on temperature gradient.

9. The system of claim 1, wherein the instructions to adjust the window covering based on temperature gradient override the instructions to adjust the window covering based on airflow.

10. The system of claim 1, wherein the microcontroller is networked to an HVAC controller, and wherein the microcontroller instructs the HVAC controller to adjust an air speed from the vent based on at least one of the temperature gradient and the airflow.

11. The system of claim 1, wherein the microcontroller is networked to an HVAC controller, wherein the first temperature is lower than the second temperature, and wherein the microcontroller instructs the HVAC controller to adjust a temperature of the airflow to match the second temperature.

12. The system of claim 1, further comprising a motor coupled to one or more air vent adjustable slats and the microcontroller and wherein the microcontroller instructs the motor to adjust the slats based on at least one of the temperature gradient and the airflow.

* * * * *